United States Patent [19]

Mistyurik

[11] Patent Number: 4,668,326

[45] Date of Patent: May 26, 1987

[54] HAND-HELD LABELER

[75] Inventor: John D. Mistyurik, Tipp City, Ohio

[73] Assignee: Monarch Marking Systems, Inc., Dayton, Ohio

[21] Appl. No.: 733,026

[22] Filed: May 13, 1985

[51] Int. Cl.[4] ..... B65C 11/02

[52] U.S. Cl. ..... 156/384; 100/288; 156/577; 156/579; 156/584; 156/DIG. 48; 156/DIG. 49; 242/68.4; 242/129.51

[58] Field of Search ..... 156/384, 577, 579, 584, 156/DIG. 48, DIG. 49; 101/288; 242/68.4, 68.2, 73, 129.5, 129.7, 129.71, 129.72, 68.5, 55.53, 129.51, 129.6

[56] References Cited

U.S. PATENT DOCUMENTS

| | | | |
|---|---|---|---|
| 855,038 | 5/1907 | Ball | 242/68.4 |
| 980,279 | 1/1911 | Ireland | 242/68.4 |
| 3,698,548 | 10/1972 | Stenzel et al. | 242/55.53 |
| 3,923,582 | 12/1975 | Schroter et al. | 156/384 |
| 4,148,678 | 4/1979 | Fogle et al. | 156/384 |
| 4,490,206 | 12/1984 | Makley | 156/384 |

*Primary Examiner*—Michael Wityshyn
*Attorney, Agent, or Firm*—Joseph J. Grass

[57] ABSTRACT

There is disclosed a hand-held labeler with roll mounting members adapted to mount a label supply roll, together with mechanism to move the roll holding members relatively away from each other to facilitate loading and unloading label supply rolls. The labeler includes a protective cover and the mechanism is operated upon movement of the cover between closed and open positions.

19 Claims, 8 Drawing Figures

HAND-HELD LABELER

BACKGROUND OF THE INVENTION

1. Field of the Invention

The invention relates to the labeling field.

2. Description of the Prior Art

The following prior art is made of record: U.S. Pat. No. 3,968,745 of Paul H. Hamisch, Jr. granted July 13, 1976; U.S. patent application Ser. No. 408,310, filed Aug. 16, 1982 of Paul H. Hamisch, Jr., now U.S. Pat. No. 4,619,727 (corresponding U.K. patent application No. 2132167A): and U.S. Pat. No. 4,490,206 of James A. Makley granted Dec. 25, 1985.

SUMMARY OF THE INVENTION

It is a feature of the invention to provide an improved hand-held labeler with a protective cover with mechanism to facilitate loading and unloading of a label supply roll in response to movement of the cover.

It is another feature of the invention to provide an improved hand-held labeler in which a label supply roll can be mounted in mounting members in which the labeler includes a mechanism for moving at least one and preferably both roll mounting members away from each other to facilitate loading and unloading of label rolls.

It is a feature of the invention to provide an improved hand-held labeler in which operation of a protective cover for the label roll effects camming of the mounting structure for the label supply roll to facilitate loading and unloading label rolls from the labeler. It is a feature of the invention to provide a label roll cover for a hand-held labeler in which movement of the cover from a closed position to an open position will facilitate release of the label roll but only when the cover is near its open position.

In accordance with a specific embodiment of the invention a hand-held thermal labeler is provided with a cover which protects the label supply roll from dust, debris and damage. The label roll is supported on a pair of roll mounting members which are movable relative toward and away from each other between a label roll mounting position and a release position from which the label roll can be readily released. The cover operates cam means which effect movement of the roll holding members. A spring is used to urge a cam follower against the cam.

Although it is preferred to use compression springs to urge the roll mounting members toward each other, by an alternative construction the cam follower can be captive in a cam track so that both inward and outward movements of the roll mounting members can be effected by the cam means without the aid of any springs.

Although both roll mounting members are moved, it is within the purview of the invention to move only one roll mounting member to release the label supply roll.

Although the roll mounting members are shown to be moved outwardly beyond the sides of the label roll as is preferred, the cam means can be constructed to move the roll mounting members outwardly to a position in which there is still interference or slight holding of the label roll because the roll mounting members do not clear the sides of the label roll.

DESCRIPTION OF THE PREFERRED EMBODIMENT

Figure 1:
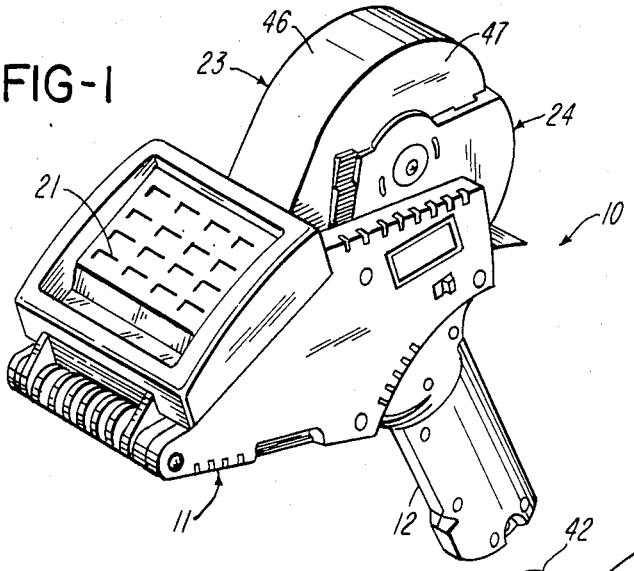
FIG. 1 is a perspective view of a hand-held labeler in accordance with one embodiment of the invention.
Figure 2:
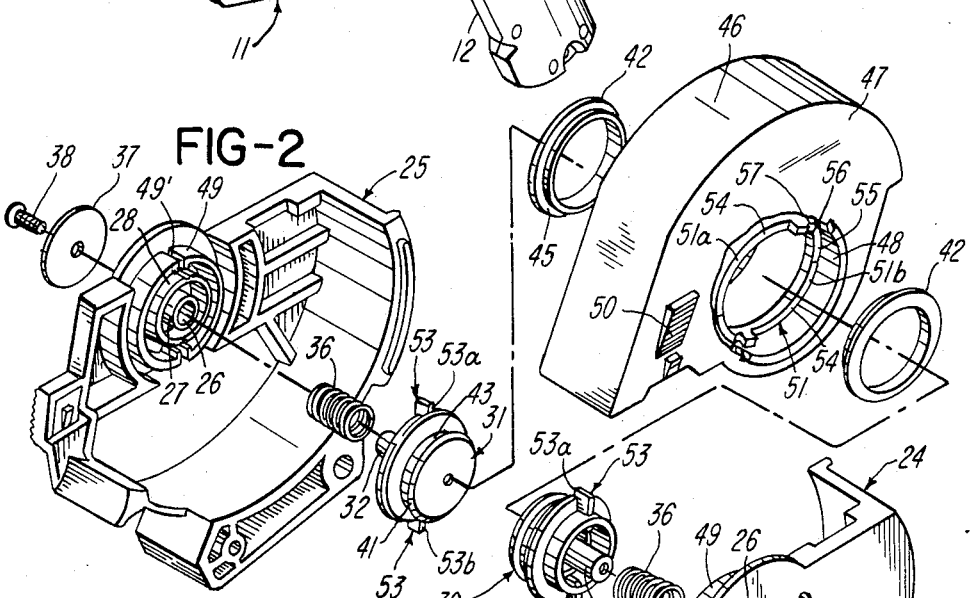
FIG. 2 is an exploded perspective view of housing structure, a cover, roll mounting members, a protective cover and an arrangement for moving the roll mounting members relatively away from each other to facilitate loading and unloading of label rolls.
Figure 3:
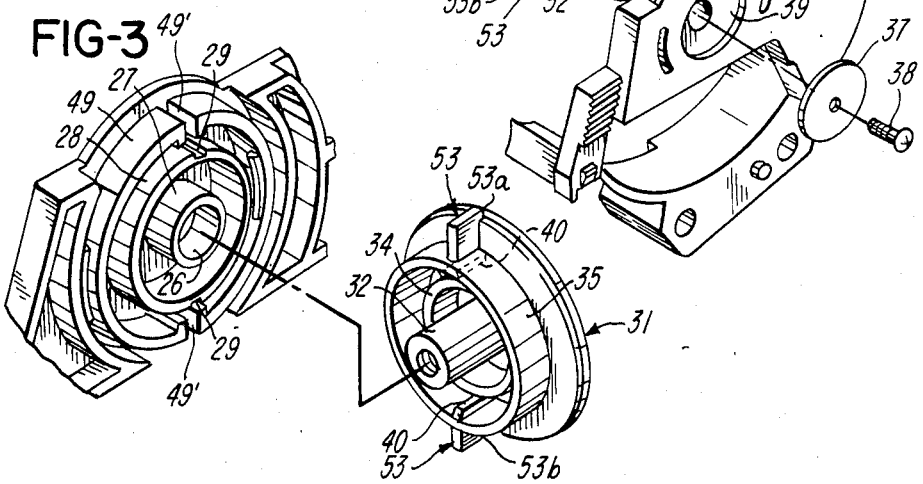
FIG. 3 is an enlarged exploded perspective view, with the housing structure and one of the roll mounting members mounted thereby, rotated to promote clarity of illustration.
Figure 4:
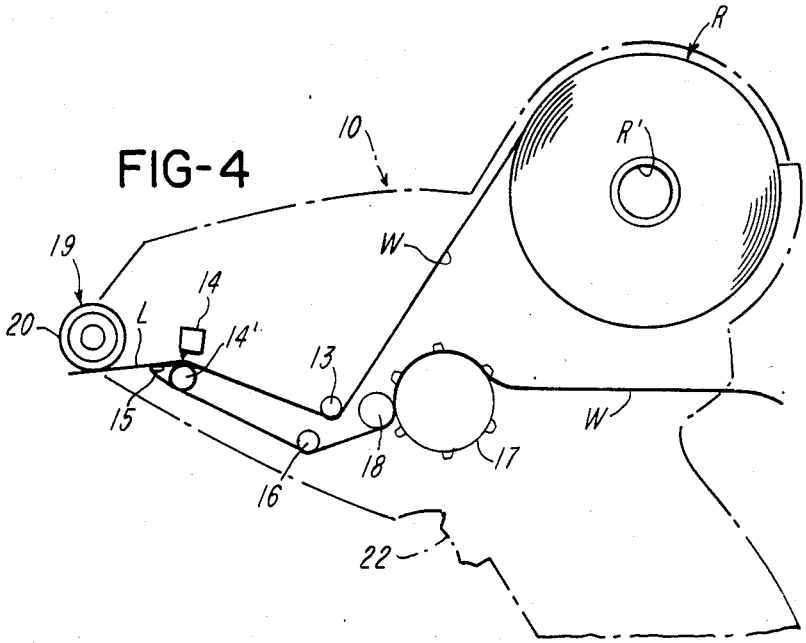
FIG. 4 is a diagrammatic side elevational view showing the path of the label carrying web.

Referring to FIGS. 1 and 4 initially there is shown a hand-held labeler generally indicated at 10 having a housing generally indicated at 11 with a handle 12. The labeler 10 rotatably mounts a label supply roll R. The roll R is comprised of a carrier web W on which a series of pressure sensitive labels L are releasably adhered by pressure sensitive adhesive. The web W is threaded through the labeler 10 along a path diagrammatically illustrated in FIG. 4 and including a guide roller 13, a thermal print head 14 and a platen roller 14', a peel roller or delaminator 15, a guide roller 16 and a toothed feed wheel 17 and a back-up roll 18. The leading label L is delivered into underlying relationship with respect to an applicator 19 in the form of a roll 20. A keyboard 21 is mounted on the housing 11. Following entry of data into the keyboard 21, printing and feeding is effected by each operation of a manual switch 22. A cover generally indicated at 23 protects the label roll R from dust, debris and damage. For further details of a labeler of the type to which the invention is applied reference may be had to U.S. Pat. No. 4,490,206 incorporated herein by reference.

Figure 7:
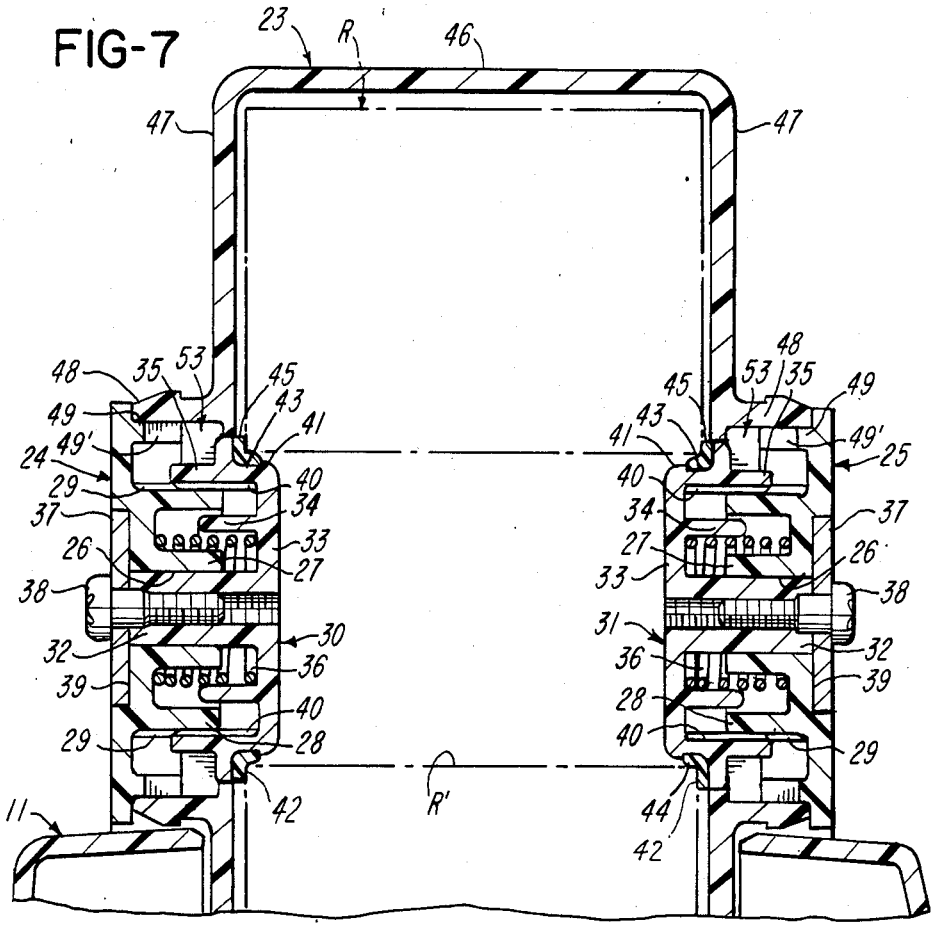
FIG. 7 is a generally vertical sectional view showing the label roll supported by the mounting members.

The housing 11 includes a pair of mirror-image housing sections generally indicated at 24 and 25. The housing sections 24 and 25 have axially aligned holes 26 defined by tubular members 27. Spaced about the respective tubular members 27 is another tubular member 28 having a pair of external guide grooves 29. A pair of identical roll mounting members 30 and 31 mount the label supply roll R. Each roll mounting member 30 and 31 has a central stud or shaft 32 received in the respective hole 26. The stud 32 is integrally formed with a wall 33. Spaced outwardly from the stud 26 is a generally annular flange 34 formed integrally with the wall 33. Spaced outwardly from the flange 34 is a generally annular flange 35. A compression coaxial spring 36 urges the respective mounting member 30 and 31 toward each other, that is, inwardly. Each spring 36 is received between the tubular portion 27 and the flange 34 and abuts against respective housing section 24 or 25 and wall 33. A washer 37 is drawn against the end of the stud 32 by a screw 38. The washer 37 abuts against surface 39 on the respective housing member 24 or 25 to limit the inward movement of the respective housing member 24 or 25. FIG. 7 shows the label supply roll mounting positions of the roll mounting members 30 and 31. The members 30 and 31 have integral keys or projections 40 which cooperate with grooves 29 to allow axial sliding movement of the members 30 and 31 but prevent rotation of the members 30 and 31.

The outer periphery of the wall 33 terminates at a ridge 41. An annular ring 42 of L-shaped section has an internal diameter slightly less than the outside diameter of the wall 33 at the ridge 41. The ring 42 is resilient enough to be snapped over the ridge 41. The ring 42 is loose enough to rotate freely on surface 43 of the member 30 or 31. Horizontal leg 44 of the ring 41 enters a central opening or hole R′ in the label roll R and vertical leg 45 supports a marginal outer side of the roll R adjacent the opening R′.

Figure 5:
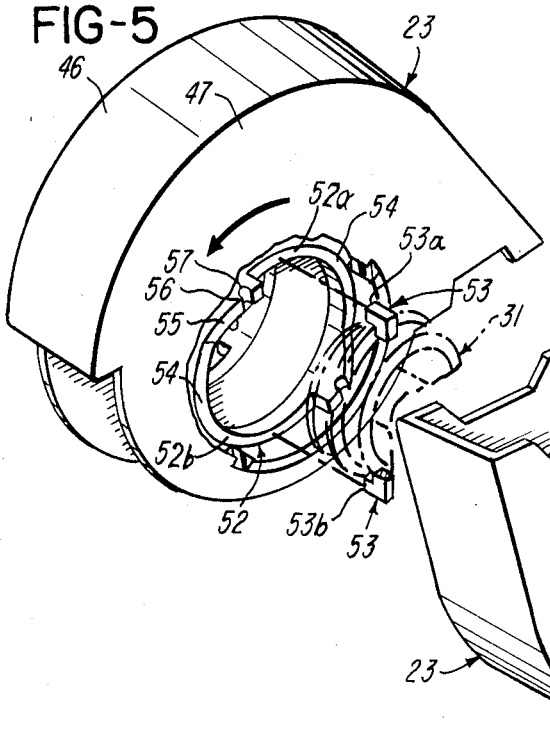
FIG. 5 is a partly broken-away perspective view of the cover in the closed position with the associated roll mounting member shown by phantom lines.

The cover 23 has a generally arcuate portion 46 joined to walls 47. The walls 47 have outwardly extending tubular portions or flanges 48 rotatably supported by annular portions 49 of housing sections 24 and 25. The cover 23 is pivotal from the closed position shown in FIGS. 1 and 5 to the open position shown in FIG. 6. The cover 23 protects the label roll R in its closed position but enables a label roll R to be inserted or removed from the labeler 10 in the open position.

The cover 23 is a manually engageable member which can be grasped by the user by spaced friction pads 50 (only one of which is shown) and pivoted between closed and open positions. The cover 23 has two pairs or sets of cams 51 and 52 for respective roll holding members 30 and 31. The members 30 and 31 have integrally formed cam followers 53. The cam followers 53 of the member 30 cooperates with the cam 51, and the cam follower 53 of the member 31 cooperates with the cam 52. Each cam 51 and 52 includes a respective subset of cams 51*a* and 51*b* and 52*a* and 52*b*. The cams 51*a* and 51*b* are 180° apart and are identical to each other, and the cams 52*a* and 52*b* are 180° apart and are identical to each other. Each cam follower 53 includes a subset of cam followers 53*a* and 53*b*. Cam followers 53*a* of the members 30 and 31 cooperate with respective cams 51*a* and 52*a*, and cam followers 53*b* of the members 30 and 31 cooperate with respective cams 51*b* and 52*b*. Thus, the action of the cams 51 on the cam followers 53 is balanced and there is no tendency for the studs 32 to bind in the holes 26.

Figure 6:
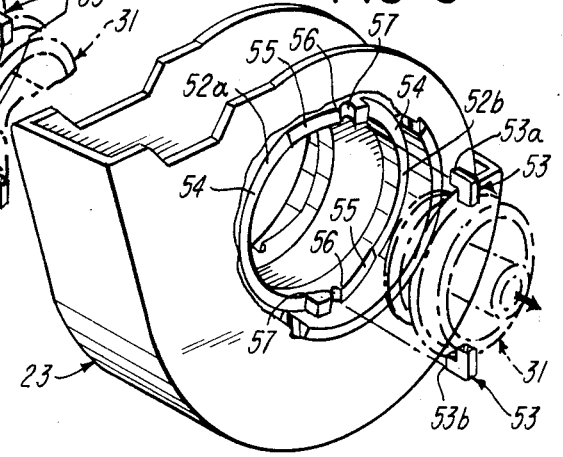
FIG. 6 is a view like FIG. 5 but showing the cover in the open position.

Each of the cams 51*a*, 51*b*, 52*a* and 52*b* has a relatively long dwell portion 54, a relatively short rise portion 55 terminating at a high point 56 and a detent notch 57 immediately beyond the high point 56. The cam followers 53*a* and 53*b* contact the dwell portion 54 over 125° and the inclined cam portion over 32° upon movement of the cover 23 from the closed position (FIGS. 1 and 5) to the open position (FIG. 6). Immediately after the cams 51 and 52 move past the high points 56, the cam followers 53 descend slightly into detent recesses or notches 57 under the action springs 36, thereby releasably holding or detenting the cover 23 in the open position. When the user desires to close the cover 23, the user pivots the cover 23 so that the cam followers 53 move out of the respective detent notches 57, and contact high point 56, inclined cam portion 55 and dwell portion 54 in sequence.

Figure 8:
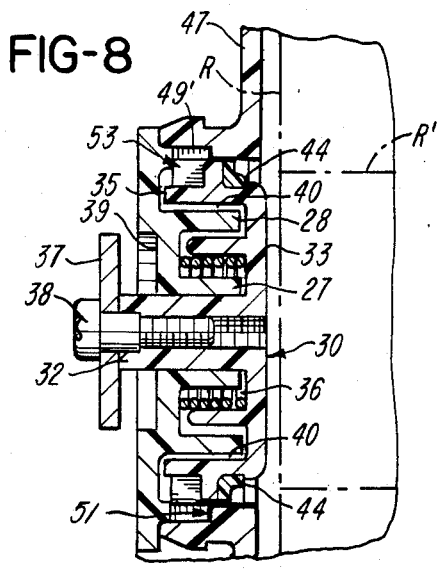
FIG. 8 is a view similar to the left side of FIG. 7, but showing the roll mounting member moved to the left against the action of the spring.

The inclined cam portions 55 are operative essentially only at or near the end portion of the open position. It is only on the portions 55 and, of course, the detent portion 57 when the follower 32 is in the notch 57 that the roll mounting members 30 and 31 are moved apart out of the position shown in FIG. 8. Whatever the movement of the members 30 and 31 away from each other, the easier it is to insert or remove a label roll R from mounted engagement therewith.

It is understood that, if desired, only one cam acting on one cam follower of one roll holding member can be used so that only one roll holding member moves, but such is not the preferred construction.

Other embodiments of modifications of the invention will suggest themselves to those skilled in the art, and all such of these as come within the spirit of this invention are included within its scope as best defined by the appended claims.

I claim:

1. A labeler adapted to print and apply pressure sensitive labels releasably secured to a carrier web, comprising: a housing, means for mounting a label supply roll on the housing, a protective cover mounted on the housing for movement between open and closed positions, means for printing on labels, means for delaminating printed labels, means for advancing the carrier web, means defining a path for guiding the web from the label roll to the printing means and to the delaminating means and into engagement with the web advancing means, and means including a cam responsive to movement of the cover for releasing the label roll from the label supply roll mounting means.

2. A labeler adapted to print and apply pressure sensitive labels releasably secured to a carrier web, comprising: a housing, means for mounting a label supply roll on the housing, a protective cover for the label supply roll mounted on the housing for movement between open and closed positions, means for printing on labels, means for delaminating printed labels, means for advancing the carrier web, means defining a path for guiding the web from the label roll to the printing means and to the delaminating means and into engagement with the web advancing means, and means responsive to movement of the cover for facilitating release of the label roll from the label supply roll holding means, wherein the label supply roll mounting means includes a pair of roll mounting members, means for movably mounting at least one of the roll mounting members toward and away from the other roll mounting member, and the release facilitating means including a cam follower on the movable mounting member and a cam on the cover cooperable with the cam follower.

3. A labeler adapted to print and apply pressure sensitive labels releasably secured to a carrier web, comprising: a housing, means including a pair of roll mounting members for mounting a label supply roll on the housing, a protective cover for the label supply roll mounted on the housing for movement between open and closed positions, means for printing on labels, means for delaminating printed labels, means for advancing the carrier web, means defining a path for guiding the web from the label roll to the printing means and to the delaminating means and into engagement with the web advancing means, and means effective only at and near the open position of the cover for moving the roll mounting members apart relative to each other to facilitate insertion or removal of a label roll.

4. A labeler as defined in claim 3, wherein at least one of the roll mounting members is movably mounted and the moving means includes a cam on the cover and a cooperable cam follower surface for operating the movable roll mounting member.

5. A labeler as defined in claim 3, wherein the roll mounting members are movably mounted and the moving means includes a pair of cams on the cover and a cooperable pair of cam follower surfaces for operating the movable roll mounting members.

6. A labeler as defined in claim 4, including means formed partly by the cam for detenting the cover in the open position.

7. A labeler as defined in claim 5, including means formed partly by the cams for detenting the cover in the open position.

8. A labeler as defined in claim 4, including a spring for urging the movable roll mounting member toward the other roll mounting member.

9. A labeler as defined in claim 5, including springs for urging the roll mounting members toward each other.

10. A labeler as defined in claim 4, wherein the cam has a relatively long dwell portion, a relatively short inclined cam portion terminating at a high point and a detent recess below the high point so that opening movement of the cover and contact of the cam follower with the dwell portion does not effect movement of the movable mounting member, but movement of the cover while the cam follower is in contact with the inclined cam portion cams the movable roll mounting member away from the other roll mounting member, and engagement of the cam follower with the detent notch causes the cover to be detented in the open position.

11. A labeler as defined in claim 10, wherein there are a pair of said cams arranged 180° apart, and there are a pair of cam followers arranged 180° apart.

12. A labeler adapted to print and apply pressure sensitive labels releasably secured to a carrier web, comprising: a labeler housing, means for mounting a label supply roll on the housing, means for printing on labels, means for delaminating printed labels, means for advancing the carrier web, means defining a path for guiding the web from the label roll to the printing means and to the delaminating means and into engagement with the web advancing means, wherein the mounting means includes a pair of roll mounting members adapted to cooperate with a label supply roll at its central opening and means for movably mounting the roll mounting members for relative movement toward each other to a label supply roll supporting position and away from each other to a label supply roll releasing position, manually operable means mounted on the labeler housing for selectively moving the roll mounting members between the supporting position and the releasing position, and wherein the moving means includes a pair of cams each having a rise portion and a dwell portion.

13. A labeler as defined in claim 12, wherein the roll mounting means further includes means for guiding the roll mounting members for only axial movement, and wherein the rise portions cam the roll mounting members between the supporting position and the releasing position.

14. A labeler as defined in claim 13, wherein the moving means includes a compression spring for urging each respective roll mounting member to the supporting position.

15. A labeler as defined in claim 12, including a rotatable bearing mounted on each roll mounting member and received in the opening in the label roll.

16. A labeler adapted to print and apply pressure sensitive labels releasably secured to a carrier web, comprising: a labeler housing, means for mounting a label supply roll on the housing, means for printing on labels, means for delaminating printed labels, means for advancing the carrier web, means defining a path for guiding the web from the label roll to the printing means and to the delaminating means and into engagement with the web advancing means, wherein the mounting means includes a pair of roll mounting members adapted to cooperate with a label supply roll at its central opening and means for movably mounting the roll mounting members for relative movement toward each other to a label supply roll supporting position and away from each other to a label supply roll releasing position, manually operable means mounted on the housing for selectively moving the roll mounting members between the supporting position and the releasing position, and wherein the moving means includes a pair of coaxial cams for moving the roll mounting members to one of said positions.

17. A labeler as defined in claim 16, including means for guiding the roll mounting members for straight line movement.

18. A labeler adapted to print and apply pressure sensitive labels releasably secured to a carrier web, comprising: a housing, means for mounting a label supply roll on the housing, means for printing on labels, means for delaminating printed labels, means for advancing the carrier web, means defining a path for guiding the web from the label roll to the printing means and to the delaminating means and into engagement with the web advancing means, wherein the mounting means includes a pair of roll mounting members adapted to cooperate with a label supply roll at its central opening and means for movably mounting at least one of the roll mounting members for movement toward the other roll mounting member to a label roll supporting position and away from the other roll mounting member to a label roll releasing position, a protective cover for the label supply roll, and means controlled by the cover for selectively moving the movable roll mounting member between the supporting position and the releasing position.

19. A labeler adapted to print and apply pressure sensitive labels releasably secured to a carrier web, comprising: a housing, means for mounting a label supply roll on the housing, a protective cover for the label supply roll, means for printing on labels, means for delaminating printed labels, means for advancing the carrier web, means defining a path for guiding the web from the label roll to the printing means and to the delaminating means and into engagement with the web advancing means, wherein the mounting means includes a pair of roll mounting members adapted to cooperate with a label supply roll at its central opening and means for movably mounting the roll mounting members for relative movement toward each other to a label roll supporting position and away from each other to a label roll releasing position, and cams operable by the cover for selectively moving the movable roll mounting members between the supporting position and the releasing position.

* * * * *